United States Patent [19]

Watabe

[11] Patent Number: 4,660,251

[45] Date of Patent: Apr. 28, 1987

[54] HINGE-TYPE LID MOUNTING DEVICE

[75] Inventor: Takaharu Watabe, Hirakata, Japan

[73] Assignees: Santo Industries Co., Ltd.; Western Trading Co., Ltd., both of Osaka, Japan

[21] Appl. No.: 780,380

[22] Filed: Sep. 26, 1985

[51] Int. Cl.[4] ..... E05D 3/10

[52] U.S. Cl. ..... 16/367; 16/289; 16/296; 16/306; 16/371

[58] Field of Search ..... 16/367, 371, 252, 289, 16/296, 306

[56] References Cited

U.S. PATENT DOCUMENTS 1,516,747 11/1924 Maille ..... 16/367
3,496,595 2/1970 Larson ..... 16/289

FOREIGN PATENT DOCUMENTS 2343210 9/1977 France ..... 16/289
2086979 5/1982 United Kingdom ..... 16/252

*Primary Examiner*—Leonidas Vlachos
*Attorney, Agent, or Firm*—Joseph W. Farley

[57] ABSTRACT

A hinge-type lid mounting device has a main body to be attached to a case or the like, and the main body has at its one end a cam body pivotally mounted through a first pin. The other end of the main body defines a fixed spring seat, and a spring is interposed between the fixed spring seat and a movable spring seat adapted to abut the cam body. A lid supporting member is rotatably mounted on the cam body through a second pin perpendicular to the first pin. A lid is anchored at its one end to the lid supporting member through a lid anchoring member and a fixing screw.

2 Claims, 6 Drawing Figures

HINGE-TYPE LID MOUNTING DEVICE

FIELD OF THE INVENTION

This invention relates to a hinge-type lid mounting device for use in cases and the like and, more particularly, to a hinge-type lid mounting device for pivotally mounting a lid to a case or the like for opening and closing movement around a horizontal axis.

BACKGROUND OF THE INVENTION

Generally, a lid mounting device of the type has a main body to be attached to a case, and a lid supporting member rotatable around a pin provided at one end of the main body. When mounting a lid to a case, a pair of such lid mounting devices are fixed to the case in such a way that their main bodies are spaced from each other and pins thereof are positioned in alignment, and then one end of the lid is clamped to lid supporting members.

However, it is difficult to fix the main bodies of the both lid mounting devices to the case so that their pins may be positioned in alignment, and in reality some mounting error is inevitable. If the mounting error is greater than tolerable, it is impossible to clamp one end of the lid to the lid supporting members, or if clamping could be done, some unreasonable force (e.g., shear force) may be exerted on the lid during opening and/or closing movement of the lid, thus resulting in lid breakage.

DISCLOSURE OF THE INVENTION

The object of the invention is to provide a hinge-type lid mounting device free from aforesaid drawback.

In order to accomplish the above said object, this invention provides a hinge-type lid mounting device comprising:

- a main body to be fixed to a case or the like, said main body having an internal space;
- a cam body having a cam face and rotatably attached to one end of the main body through a first pin;
- a first spring seat fixed to the other end of the main body;
- a second spring seat disposed in the internal space for abutment with the came face of said cam body and movable toward and away from the first spring seat;
- spring means interposed between the two spring seats; and
- a lid supporting member attached to said cam body outside said main body through a second pin perpendicular to said first pin and adapted to receive one end of a lid.

DESCRIPTION OF EMBODIMENT

Figure 1:
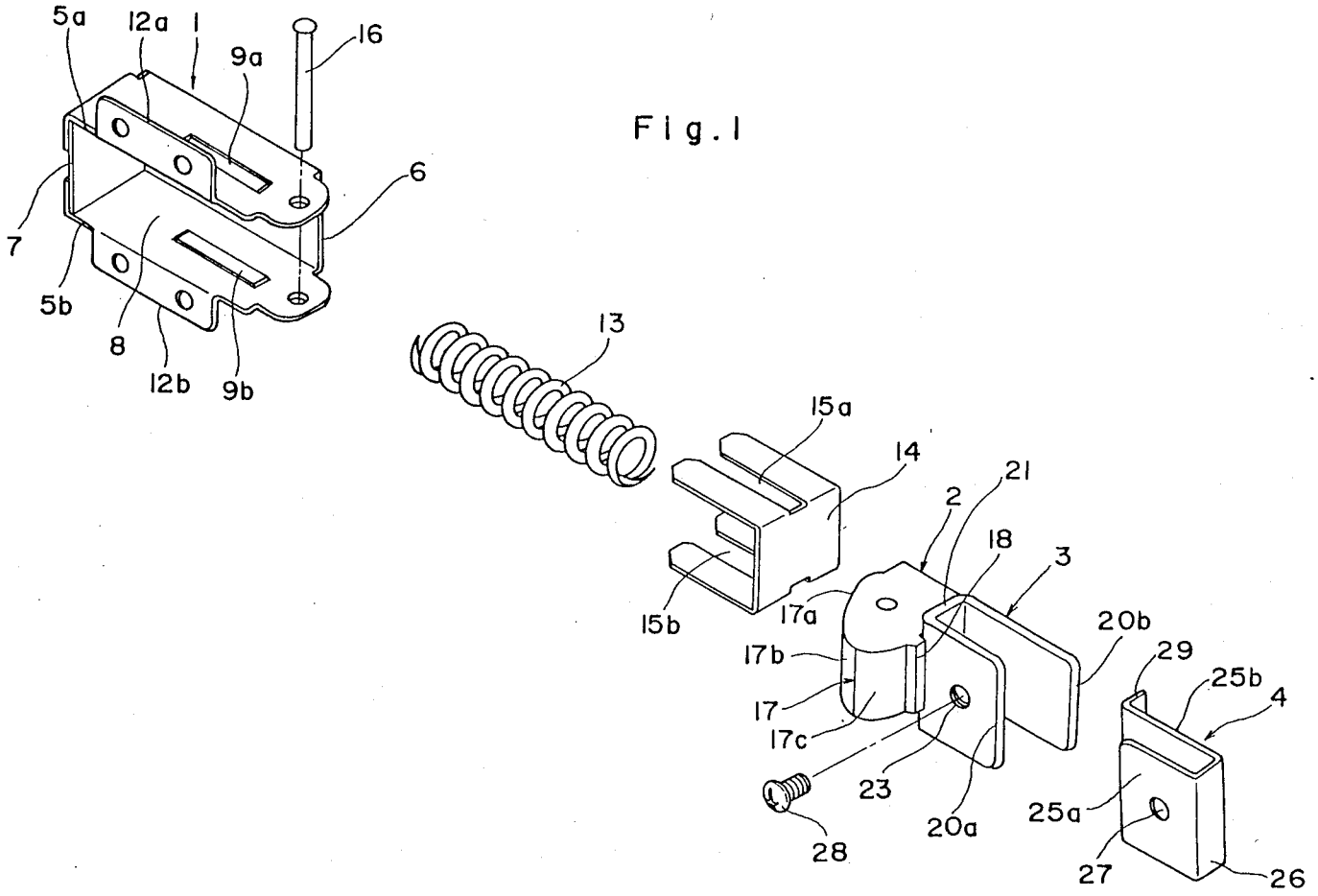
FIG. 1 is an exploded perspective view illustrating a hinge-type lid mounting device according to one embodyment of the invention.
Figure 2A:
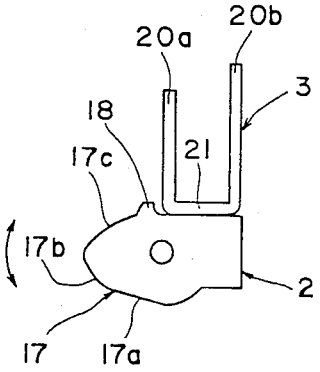
FIGS. 2*a* and 2*b* are side and plan views showing key portions of the lid mounting device.
Figure 2B:
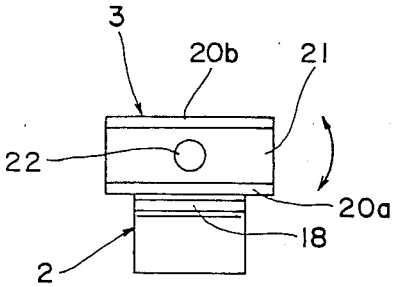
Figure 3:
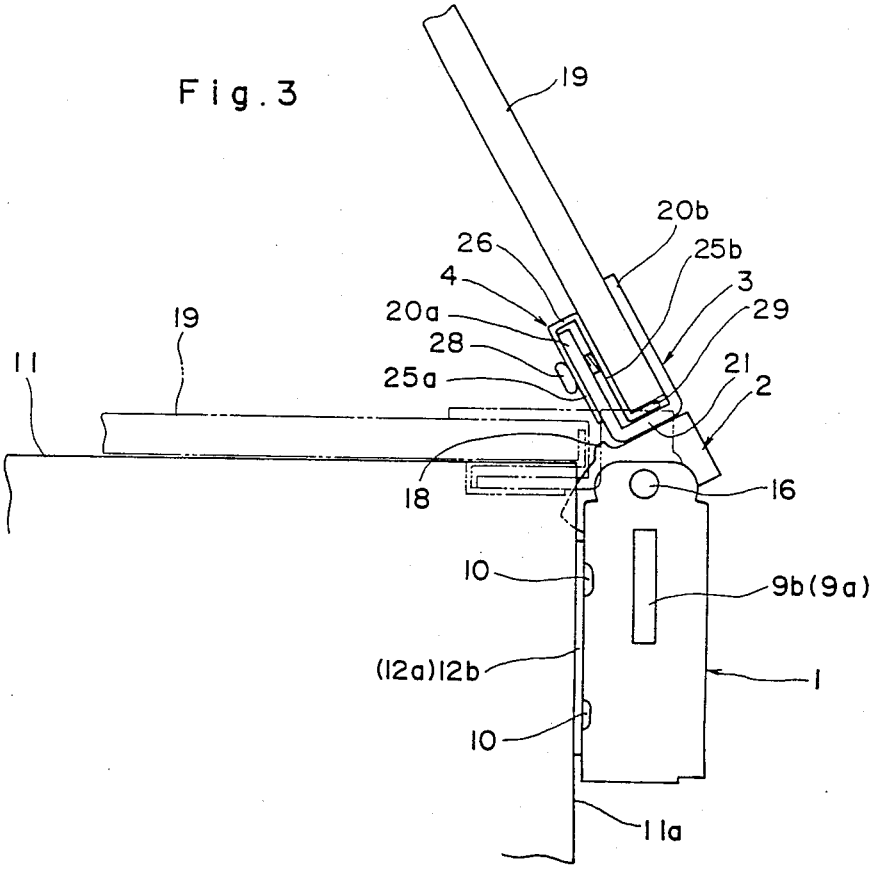
FIG. 3 is a side view showing a lid as it appears when mounted to a case by means of the lid mounting device.

Referring to FIGS. 1 through 3, a hinge-type lid mounting device has, as its main components, a main body 1, a cam body 2, a lid supporting member 3, and a lid anchoring member 4.

The main body 1 has a pair of side walls 5*a*, 5*b*, a web 6 connecting the side walls 5*a*, 5*b* to each other, and at one end of the main body 1 an end wall 7 which serves as a first spring seat. These walls 5*a*, 5*b*, 6, and 7 define an internal space 8. The side walls 5*a*, 5*b* respectively have guide projections 9*a*, 9*b* and mount flanges 12*a*, 12*b* for fixing them to a back plate 11*a* of a case 11 by means of screws 10. The internal space 8 accomodates a compression coil spring 13 and a second spring seat 14. The second spring seat 14 has guide slots 15*a*, 15*b* adapted to fit on the guide projections 9*a*, 9*b* and is movable longitudinall of the main body 1.

The cam body 2 is rotatably mounted to the other end of the main body 1 through a first pin 16. The cam body 2 has a cam face 17 against which the second spring seat 14 is pressed by biasing force of the spring 13, and it also has a stopper ledge 18 extending parallel to the first pin 16. The cam face 17 has a planar portion 17*a* corresponding to the opened position of a lid 19 (shown in solid lines in FIG. 3), a curved portion 17*b* continuous with the planar portion 17*a* and increasingly spaced apart from the first pin 16 as it extends away from the planar portion 17*a*, and a terminal portion 17*c* continuous with the curved portion 17*b* and curved so that it becomes less distant from the first pin 16 as it extends away from the curved portion 17*b*. The terminal portion 17*c* corresponds to the closed position of the lid 19 (shown in phantom lines in FIG. 3).

The lid supporting member 3 is generally U-shaped and has first and second side walls 20*a*, 20*b* parallel to each other and a web 21 connecting the side walls 20*a*, 20*b* and rotatably connected to the cam body 2 through a second pin 22 (FIG. 2*b*) perpendicular to the first pin 16. The first side wall 20*a* is disposed slightly apart from the stopper ledge 18 and is engageable with the stopper ledge 18 as the lid supporting member 3 pivots on the second pin 22. The length of the stopper ledge 18 and the distance between the first side wall 20*a* and the stopper ledge 18 are designed so that the lid supporting member 3 may have a total pivotal angle of 10°, for example. The first side wall 20*a* has a threaded hole 23 provided generally centrally thereof.

The lid anchoring member 4 has first and second side walls 25*a*, 25*b* parallel to each other and a web 26 connecting the side walls 25*a*, 25*b* and is loosely fitted on the side wall 20*a* of the lid supporting member 3. The first side wall 25*a* of the lid anchoring member 4 is located outside the side wall 20*a* of the lid supporting member 3, while the second side wall 25*b* of the lid anchoring member 4 is located between the side walls 20*a*, 20*b* of the lid supporting member 3. The first side walls 25*a* of the lid anchoring member 4 has a throughhole 27 into which an anchoring screw is loosely inserted. The second side wall 25*b* of the lid anchoring member 4 has, at one end thereof remote from the web 26, a hook portion 29 perpendicular to said side wall 25*b*.

To mount the lid 19 to the case 11 by using the hinge-type lid mounting device of the above-described construction, the main body 1 is fixed to the back plate 11*a* of the case 11 by means of screws 10 while the anchoring screw 28 is held in loosened state. Then, one end of the lid 19 is inserted into a gap between the second side wall 20*b* of the lid supporting member 3 and the second side wall 25*b* of the lid anchoring member 4, and one end of the lid 19 is positioned on the hook portion 29 of the lid mounting member 4. Since the pivotal movement of the supporting member 3 about the second pin 22 is restricted by the stopper ledge 18 of the cam body 2, one end of the lid 19 can readily be inserted into said gap without prior manual orientation of the supporting member 3. Finally, the anchoring screw 28 is tightened up. Thus, the front end of the anchoring screw 28 urges the second side wall 25*b* of the lid anchoring member 4 toward the lid supporting member 20*b*, so that the lid 19 is firmly clamped between them.

The hinge-type lid mounting device operates as follows.

As shown in solid lines in FIG. 3, when the lid 19 is in the opened position, the second spring seat 14 biased by the spring 13 is in pressure contact with the planar cam face 17*a* of the cam body 2, and accordingly the lid 19 is comparatively stably held in that position. If the lid 19 is then pivoted downward, the curved cam face 17*b*, which is continuous with the planar cam face 17*a* and configured as above said, goes into abutment therewith and accordingly the second spring seat 14 shifts toward the first spring seat 7, so that the biasing force of the spring 13 is increased. The vertical component is gravitational force acting on the lid 19 increases in proportion as the lid 19 moves toward the closing position; therefore, the downward force acting on the lid 19 will balance with the increasing bias of the spring 13. Thus, the lid 19 can be stopped at any desired angle within the angular range in which the curved cam face 17*b* abuts the second spring seat 14. When the lid 19 is brought to a fully closed position, a border portion between the curved cam face 17*b* and the terminal cam face 17*c*, or the terminal cam face 17*c* goes into abutment with the second spring seat 14, so that the lid is comparatively stably held in the fully closed position.

Figure 4:
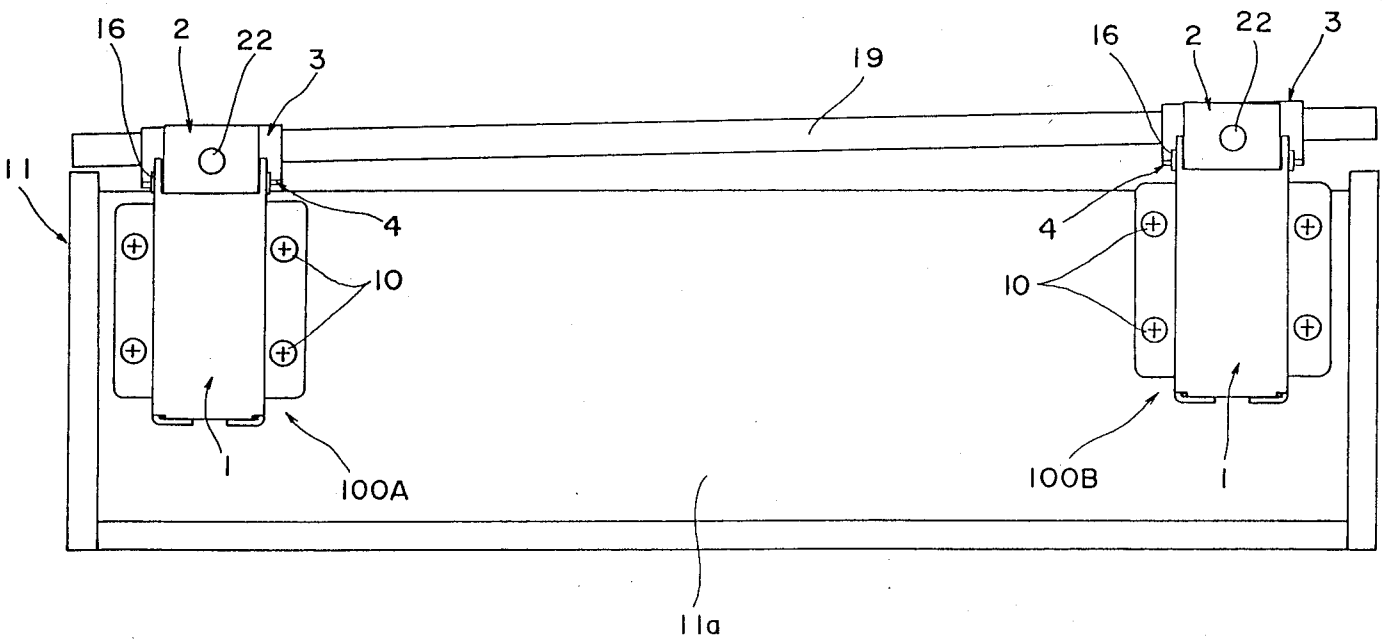
FIGS. 4 and 5 are rear views showing two different patterns in which a lid is mounted to a case by a pair of lid mounting devices attached to the case with some error.

FIG. 4 shows one form of mounting wherein the attachment of two hinge-type mounting device involves some attachment error. While one lid mounting device 100A is properly mounted on the back plate 11*a* of the case 11, the other lid mounting device 100B is mounted at a level higher than said one lid mounting device 100A. Therefore, the lid 19 is positioned at some angle to the horizontal; nevertheless, the lid supporting member 3 of each lid mounting device 100A (100B) can be pivoted about the second pin 22, so that no inconvenience is involved in connection with the mounting of the lid 19 and opening and closing movement thereof.

Figure 5:
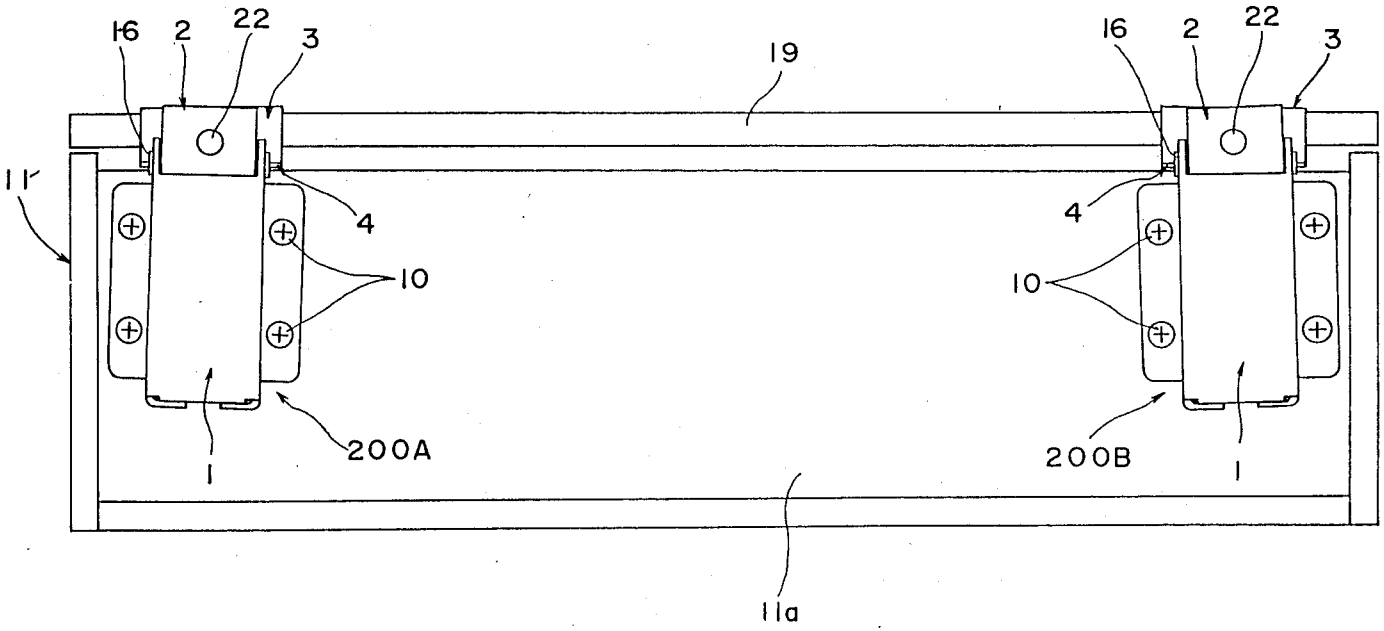

FIG. 5 shows another pattern of abnormal mounting. The lid mounting devices 200A, 200B, both are attached to the back plate 11*a* of the case 11 at an angle to the vertical. In this case, too, the lid supporting member 3 of each mounting device 200A (200B) can be pivoted about the second pin 22, and therefore, no inconvenience may be caused in mounting the lid 19. The first pin 16, which serves as a pivotal center for the lid 19, is slightly inclined relative to the horizontal, and therefore, some force urging the lid supporting member 3 to move along one clamped end of the lid 19 will develop as the lid 19 is opened and closed. However, such force has no or little effect on the opening and closing movement of the lid 19 for the following reasons:

(1) Such force is determined by the amount of inclination of the first pin 16 and the distance between the first pin 16 and the lid supporting member 4, but values of these are not so appreciable (actually, there could be no attachment error of such order as shown); therefore, said force could not be so appreciable as to pose a problem.

(2) Since the lid 19 is usually constructed of glass or the like, it resists poorly against the shearing force, but it withstands well against tensile and compression forces. The development of any shearing force can be prevented by pivotal movement of the lid supporting member 3 about the second pin 22. Therefore, there is no possibility of the lid 19 being broken during the opening and closing movement of the lid 19.

(3) Some play present in the connections between the individual parts of each lid mounting device 200A (200B) can well absorb aforesaid force.

The present inventor conducted experiments under conditions where some greater attachment error than shown is involved, but the opening and closing movement of the lid could be done smoothly, and no breakage was seen with the lid or individual lid mounting devices.

What is claimed is:

1. A hinge-type lid mounting device comprising:

a main body to be fixed to a case or the like, said main body having an internal space;

a cam body having a cam face and rotatably attached to one end of the main body through a first pin;

a first spring seat fixed to the other end of the main body;

a second spring seat disposed in the internal space for abutment with the came face of said cam body and movable toward and away from the first spring seat;

spring means interposed between the two spring seats;

a generally U-shaped lid supporting member adapted to receive one end of a lid, said supporting member having two side walls parallel to each other, a web connecting said side walls and connected to said cam body outside said main body through a second pin perpendicular to said first pin, one of said side walls having a threaded hole for receiving a fixing screw for pressing the lid against the other side wall; and a lid anchoring member attached to said lid supporting member and adapted to cooperate with said fixing screw to anchor the lid.

2. The device as set forth in claim 1 wherein said lid anchoring member is comprised of a channel to be fitted on said one side wall of said lid supporting member, and has a first side wall located at one side of said one side wall of said lid supporting member and remote from said other side wall and having a through-hole into which said fixing screw is inserted, a second side wall located between the side walls of said lid supporting member and parallel to said first side wall, said second side wall to be abutted by the front end of said fixing screw, a web connecting said first and second side wall at a location remote from the web of said lid supporting member, and a hook portion provided on said second wall at a location adjacent the web of said lid supporting member and perpendicular to said second side wall.

* * * * *